US006105262A

United States Patent [19]

Rickard

[11] Patent Number: 6,105,262

[45] **Date of Patent: *Aug. 22, 2000**

[54] REVERSIBLE BLADE KNIFE

[76] Inventor: Thomas A. Rickard, 10950 Horseback Ridge Rd., Missoula, Mont. 59801

[ * ] Notice: This patent is subject to a terminal disclaimer.

[21] Appl. No.: 09/053,442

[22] Filed: Mar. 31, 1998

[51] Int. Cl.[7] ..... B26B 9/02

[52] U.S. Cl. ..... 30/349; 30/329; 30/332; 30/340; 30/342; 30/357; 30/353

[58] Field of Search ..... 30/357, 332, 340, 30/342, 329, 349, 353

[56] References Cited

U.S. PATENT DOCUMENTS

| | | | |
|---|---|---|---|
| D. 163,562 | 6/1951 | Bjork | 30/353 |
| 528,452 | 10/1894 | Westby et al. | 30/342 |
| 949,669 | 2/1910 | Weir | 30/342 |
| 1,090,398 | 3/1914 | Humeston | 30/329 |
| 1,420,342 | 6/1922 | Richard | 30/342 |
| 2,109,108 | 2/1938 | Fesler | 30/342 |
| 2,439,071 | 4/1948 | Basham | 30/342 |
| 2,662,287 | 12/1953 | Ferguson | 30/353 |
| 3,772,955 | 11/1973 | Pearl | 30/349 |
| 4,180,909 | 1/1980 | Lind | 30/332 |
| 4,574,673 | 3/1986 | Pearl | 83/697 |
| 5,689,889 | 11/1997 | Overholt | 30/332 |

FOREIGN PATENT DOCUMENTS 27 18 638 A1 4/1977 Germany .

*Primary Examiner*—Kenneth E. Peterson
*Assistant Examiner*—Sean Pryor
*Attorney, Agent, or Firm*—Wells, St. John, Roberts, Gregory & Matkin, P.S.

[57] ABSTRACT

A knife and a reversible blade are described. A handle provides a blade mount for an elongated blade having opposed longitudinally overlapping first and second cutting edges. Handle mounting surfaces are provided on the blade, interchangeably engageable with the blade mount to enable selective attachment of the blade to the handle with either first or second cutting edges thereof exposed in an operational position.

14 Claims, 7 Drawing Sheets

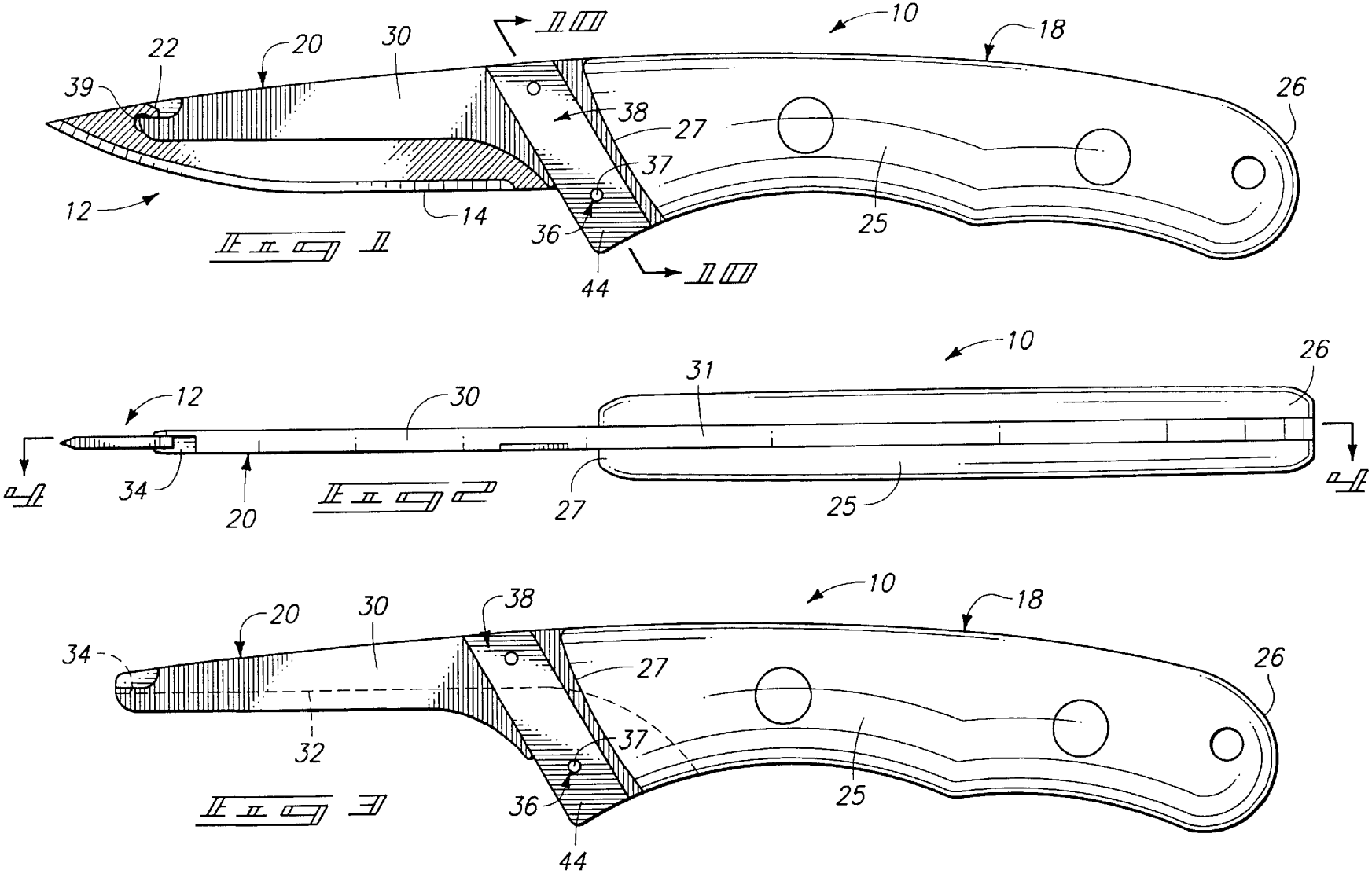
26
18
10
25
27
37
38
44
36
II
III
14
30
20
22
39
12
31
34
FIG. II
FIG. III
FIG. I
32

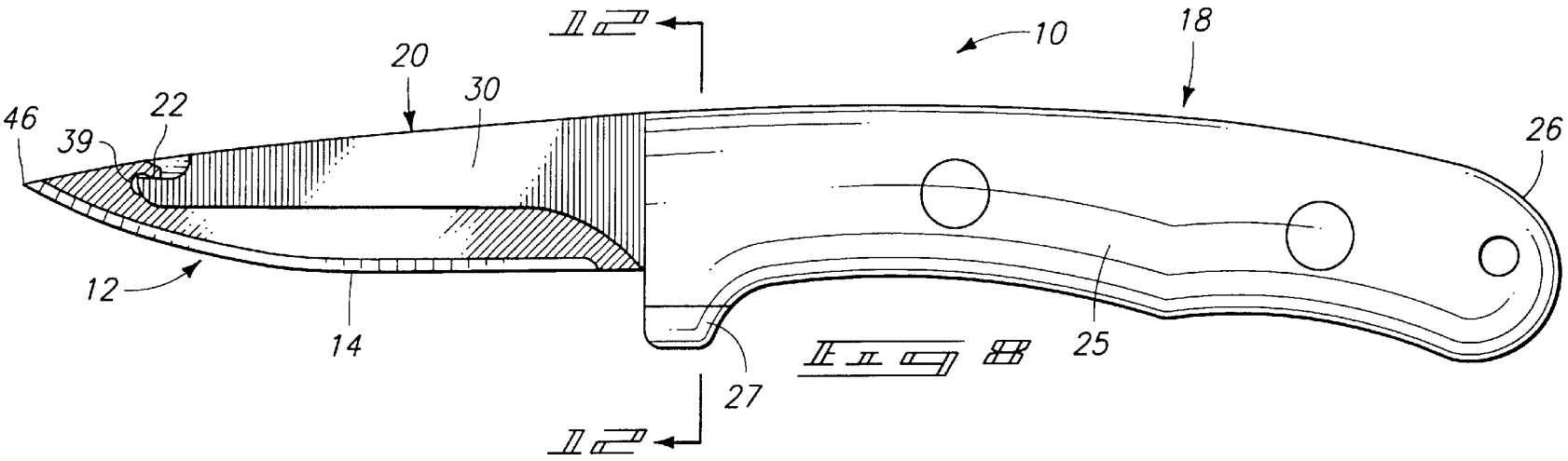
26
18
10
25
II
II
27
II
II
30
20
14
22
12
39
46
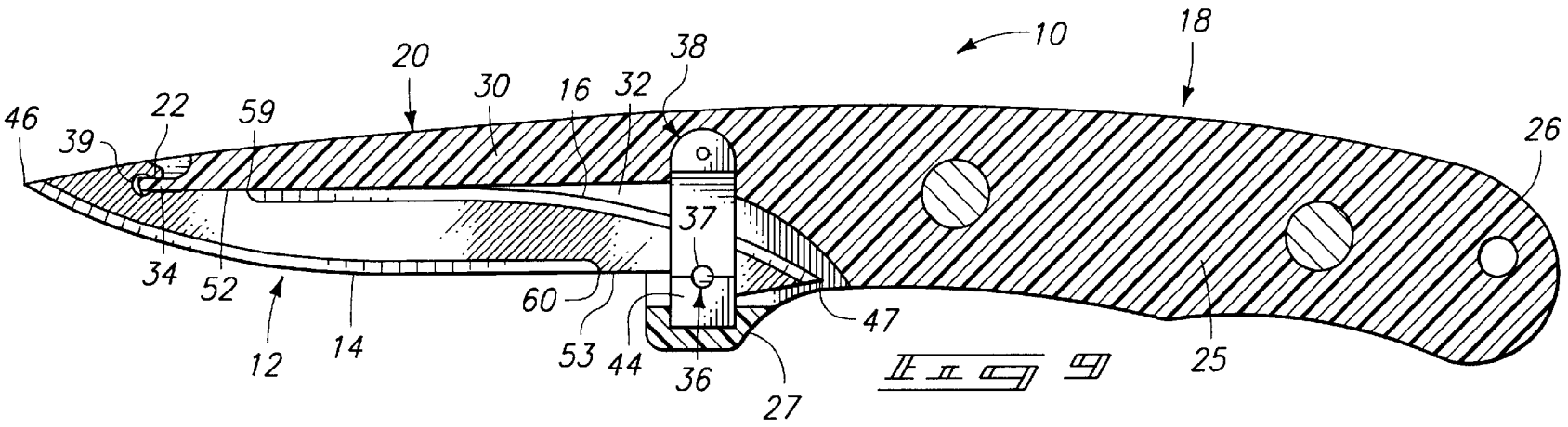
26
18
10
25
II
II
47
27
38
37
36
32
44
16
53
60
30
20
14
12
59
52
22
34
39
46

10
18
25
27
30
32
34
47
40
24
42
53
60
16
12
14
59
52
41
39
22
46
36

REVERSIBLE BLADE KNIFE

TECHNICAL FIELD

The present invention relates to cutting instruments in general and more particularly to a reversible blade knife and a reversible knife blade.

BACKGROUND OF THE INVENTION

Knives become dull at the most inopportune times. A knife blade becomes dull from use, and too often the blade will dull before the use is complete. This situation happens all too often, but is particularly true with dressing big game. The usually unpleasant job of dressing and skinning a large animal is made all the more unpleasant and time consuming when a dull knife must be used.

Of course a solution to the above problem is to stop and resharpen the dull blade. Another is to carry two sharp knives. Neither solution is adequate. Re-sharpening a blade requires sharpening tools, usually stones, that are heavy and bulky to carry. In addition, re-sharpening takes valuable time. Carrying two knives is a practice used by some, but is not economically justifiable nor is the added weight of a second knife particularly attractive to a hunter or guide who is not interested in an "armed to the teeth" look. Further, when the cutting task is complete, two knives require re-sharpening.

It is therefor an object of the present invention to provide a novel knife and a releasable blade having two opposed, longitudinally overlapping sharp edges that may be interchanged so when one edge becomes dull, the blade may be removed from the knife, reversed and remounted to expose a fresh, sharp cutting edge. Further, by providing a single knife body and a reversible blade that is removable from the knife body, several reversible blades can be easily carried without adding significantly to a pack weight. Still further, the removable reversible blade may be disposable for easy, economic replacement without requiring replacement of the knife body.

The above and further objects and advantages will become apparent from the following description which, taken with the accompanying drawings also describe the best mode presently known for carrying out the invention.

BRIEF DESCRIPTION OF THE DRAWINGS

Preferred embodiments of the invention are described below with reference to the following accompanying drawings.

FIG. 1 is a side elevational view of a first preferred form of the present reversible blade knife;

FIG. 2 is a top plan view thereof;

FIG. 3 is a side elevation view of the handle portion of the first preferred knife;

FIG. 7 is a side elevational view of another exemplary blade form;

FIG. 8 is a side elevational view of a second preferred form of the present reversible blade knife;

FIG. 9 is a sectional view of the second preferred form;

FIG. 13 is a view similar to FIG. 12 only showing a locking device in a blade release and receiving position;

FIG. 14 is an exploded perspective view showing a reversible blade and a knife handle in section.

DETAILED DESCRIPTION OF THE PREFERRED EMBODIMENTS

Figure 4:
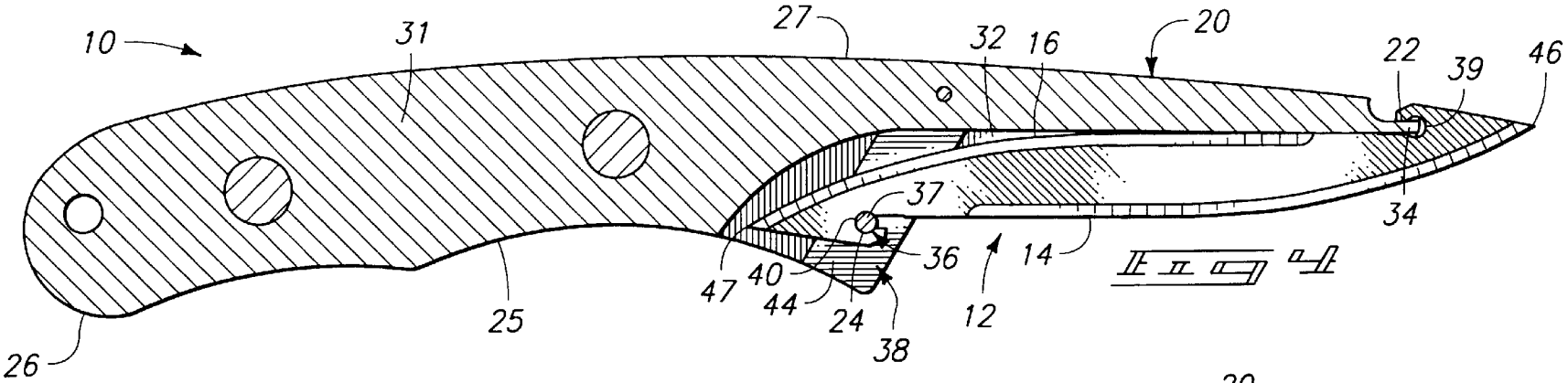
FIG. 4 is a sectional view taken substantially along line 4—4 in FIG. 2.

This disclosure of the invention is submitted in furtherance of the constitutional purposes of the U.S. Patent Laws "to promote the progress of science and useful arts" (Article 1, Section 8).

A knife embodying preferred forms of the present invention is generally designated in the accompanying drawings by the reference numeral 10. The preferred forms of the present knife 10 each include a reversible blade 12 that may be easily and quickly reversed and mounted to the knife handle 18 to expose either a first longitudinal cutting edge 14, or a second longitudinal cutting edge 16.

It is pointed out that the present blade 12 may be manufactured and sold separately for use in the present knife in such a manner that the blade may be disposable. However in the interest of materials conservation it is most preferable that the blade be re-usable and suited for re-sharpening. More discussion will be offered regarding the blade structure following a detailed description of the knife.

In general terms, the knife 10 as an assembly with the blade 12 includes the handle 18 including a blade mount 20. The blade 12 is elongated, with the first longitudinal cutting edge 14 in opposition to and longitudinally overlapping the second longitudinal cutting edge 16. The blade 12 further includes first and second handle mounting surfaces generally shown at 22, and 24 that are interchangeably engageable with the blade mount 20 to enable selective, secure attachment of the blade 12 to the handle 18 with either one of the first or second cutting edges 14, 16 exposed in an operational position.

More specifically, a preferred knife handle 18 includes a hand grip section 25 that extends between a pommel 26 at a rearward end, and a bolster 27 at a forward end. The knife handle 18 may be formed of numerous materials including both man-made materials, and natural materials that are usable for construction of knife handles.

The handle 18 also includes a rigid blade back 30 that projects from the bolster 27. It is pointed out that the rigid blade back 30 shown in the drawings is stationary with respect to the remainder of the handle 18. However the back 30 could also be movably mounted to the handle in the same manner as a blade of a folding knife or translationally slidably mounted to the handle.

In a preferred form, the blade back 30 includes a tang 31 that extends longitudinally into the handle 18 (FIGS. 13 and 14). However, it is possible that the blade back may be made integral with and formed of the same material as the remainder of the handle 18 (FIG. 8).

Many different materials may be used for the handle. For example, if a lightweight knife is desired (FIGS. 8, 9 and 12, 13) the handle 18, including the back 30 may be advantageously formed of appropriate light weight yet relatively rigid substance such as a carbon fiber impregnated plastic material. If high strength and durability is desired an appropriate steel or steel alloy may be used for the back and tang. In either example the hand grip sections 25 may be formed of another material attached to sides of the tang 31 by conventional fasteners or adhesives in a manner common to knife construction.

The rigid blade back 30 is preferably elongated and narrow, with a length dimension from bolster to tip that is less than the blade length. The back 30 is used primarily to hold and brace the blade against cutting forces that typically occur in a plane parallel to the blade sides, and are applied directly against the exposed cutting edge. One side of the blade back 30 may include an upwardly closed, downwardly open blade receiving slot 32 which releasably receives a portion of the blade 12.

The portions of the back 30 that define side walls of the blade receiving slot 32 serve to brace the blade against lateral forces and to protect the presently inoperative cutting edge. The slot does not extend upwardly through the back but instead terminates at a slot base that extends along the slot length. It is preferred that the slot 32 extend the length of the back 30 and partially into or through the bolster 27 (FIGS. 4 and 9) to accept a length of the blade rearward of the presently exposed blade tip. The slot walls and base function to effectively cover and protect one cutting edge of the blade while the other edge is exposed for use.

It is preferred that the blade mount 20 be positioned along the rigid blade back 30 to releasably secure the blade 12 in the knife. The preferred blade mount 20 includes a blade tip mounting flange 34 at a forward end and a locking device 36 adjacent the bolster.

Figure 5:
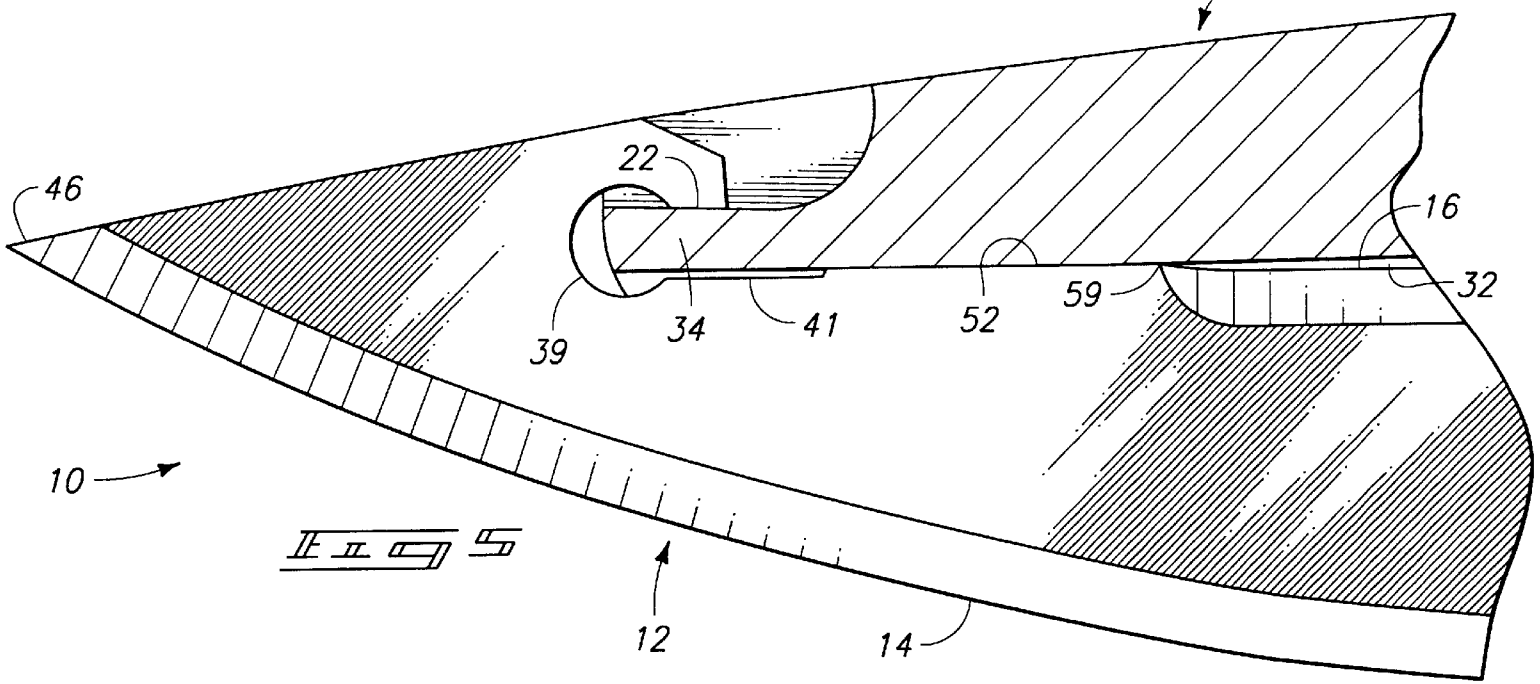
FIG. 5 is an enlarged fragmentary view of the tip portion of a preferred reversible blade and tip mounting flange of the knife back.
Figure 5:
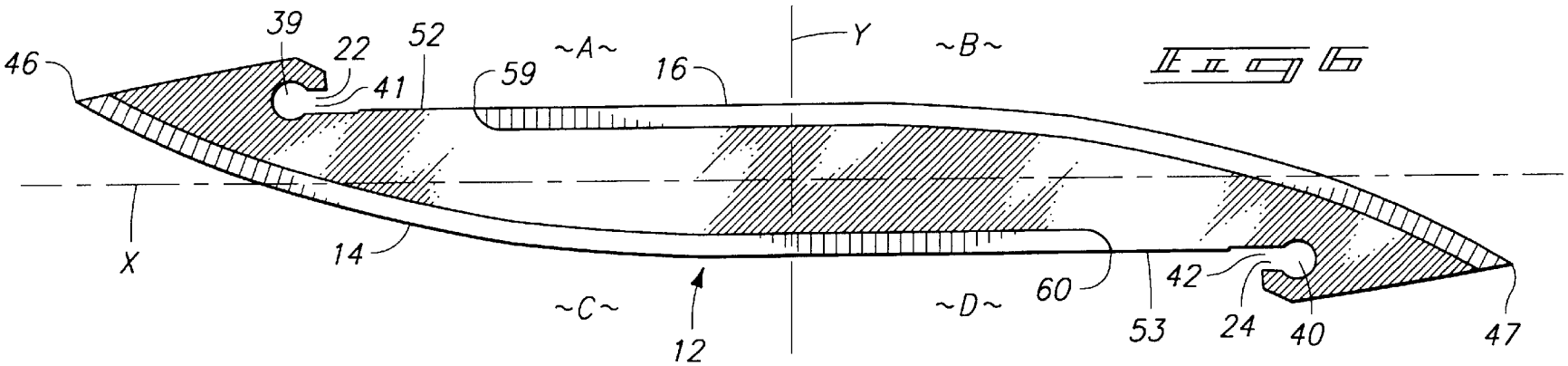

The blade tip mounting flange 34 is preferably integral with the back 30. The tip mounting flange 34 is slidably received within either a first or second mounting flange receiving slots 41, 42 (FIGS. 6, 7) that are formed in the blade 12. FIG. 5 shows the tip mounting flange 34 in detail, received within the first flange receiving slot 41. The opposed slot 41 is configured to receive the tip mounting flange 34 in the same manner when the blade is reversed. In either situation, the tip mounting flange operates to locate the blade within the blade receiving slot 32 and to prevent the blade from slipping downwardly (with reference to FIG. 5) from engagement with the back 32.

In the examples illustrated, the locking device 36 is comprised of a pin 37 that is releasably received in one of two (first and second) locking device receiving receptacles 39, 40 that are formed in the blade. The first and second slots 41, 42 open into the respective receptacles 39, 40. The pin 37 in FIG. 4 is shown received within the second receptacle 40.

Figure 11:
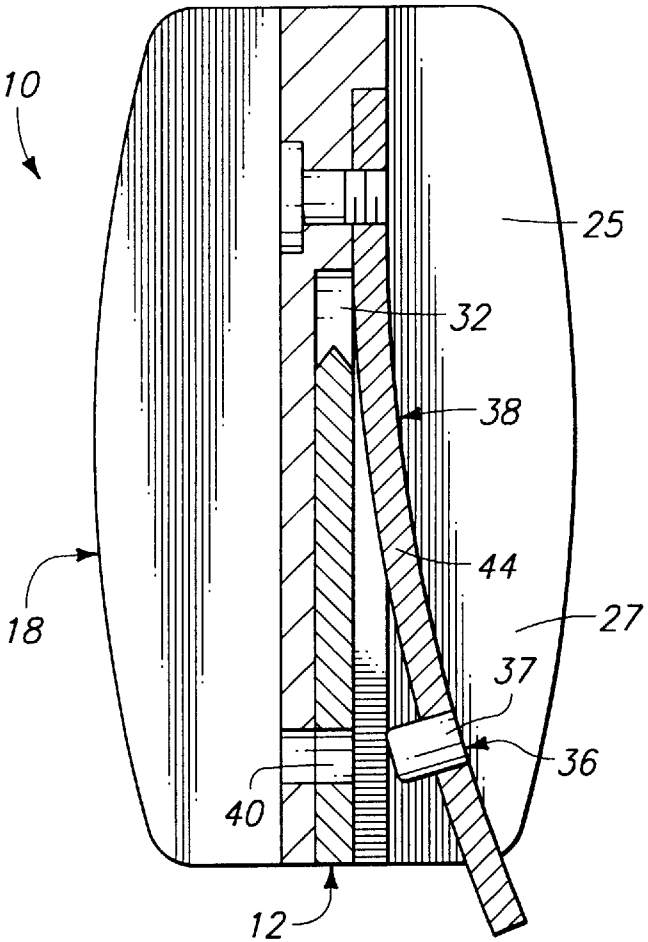
FIG. 11 is a view similar to FIG. 10 only showing a locking device in a blade release and receiving position.
Figure 10:
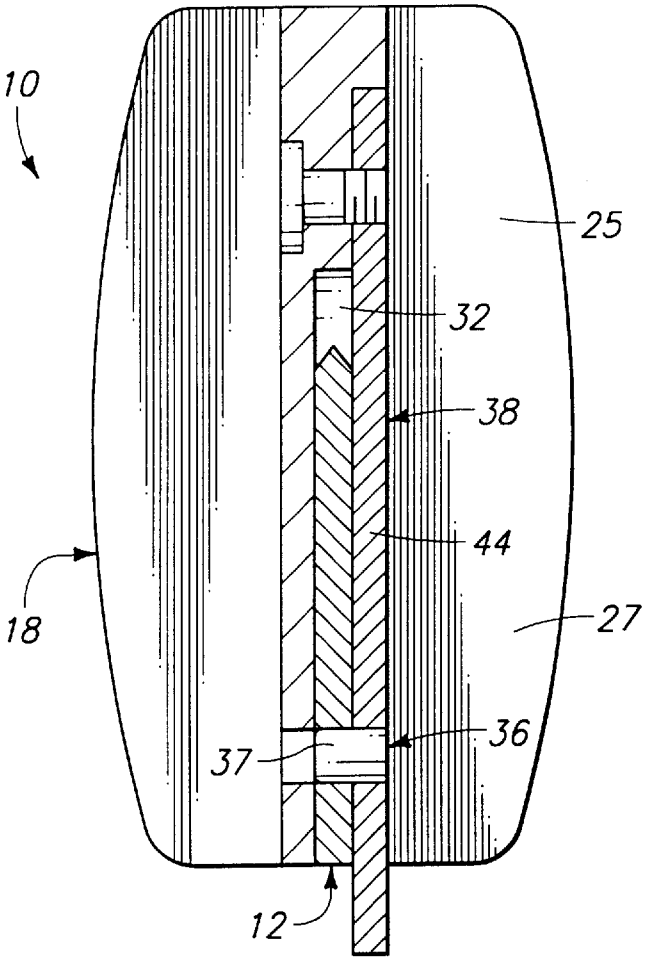
FIG. 10 is an enlarged sectional view of the first preferred knife taken along line 10—10 in FIG. 1.
Figure 11:
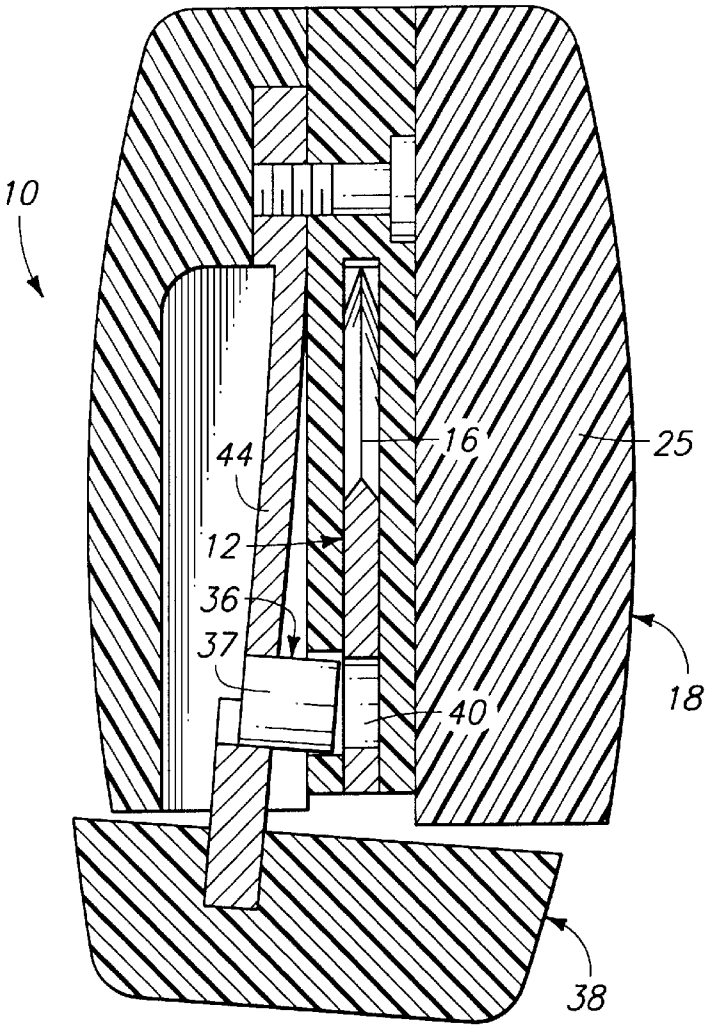
Figure 12:
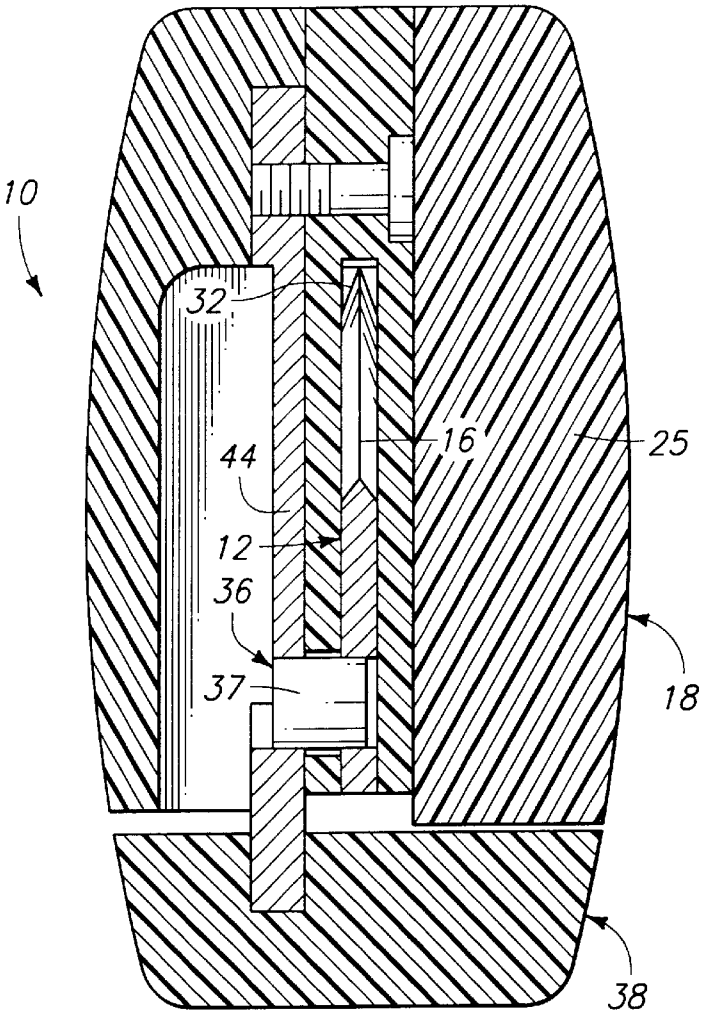
FIG. 12 is an enlarged sectional view of the second preferred knife taken along line 12—12 in FIG. 8.
Figures 11, 15:
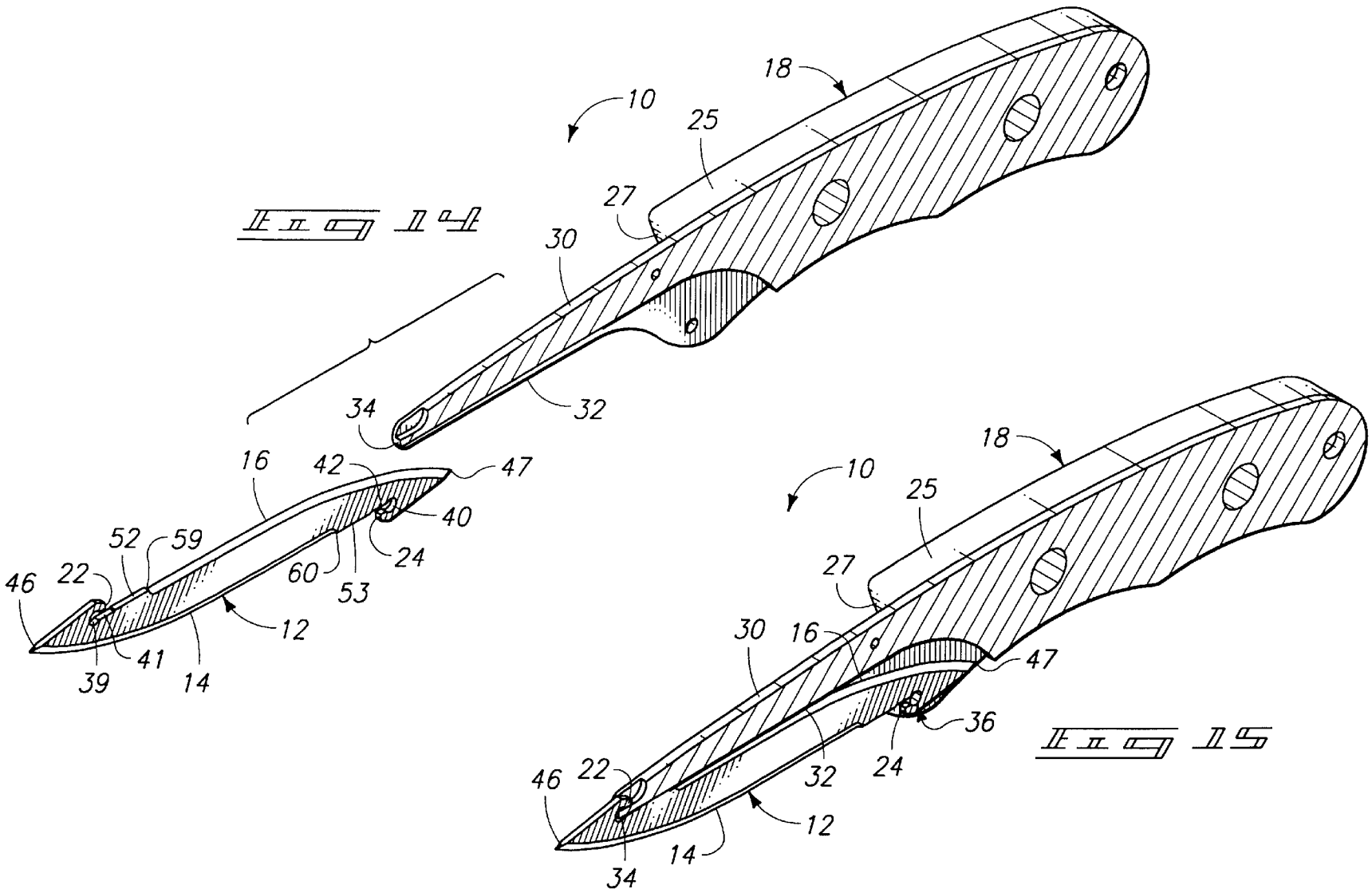
FIG. 15 is a perspective assembled view of the sectioned knife and blade shown in FIG. 14.

In preferred forms of the blade mount 20, a release 38 securely mounts the locking device 36 to the handle 18 and is configured to enable manual movement of the locking device 36 between a blade locking position (FIGS. 10 and 12) and a blade release and receiving position (FIGS. 11, and 13).

The exemplary release 38 is shown as a spring plate 44 that is secured at one end to the handle by means of an appropriate fastener 45. Locking device 36 is mounted at the opposite, free end of the plate 44. It is preferred that the plate 44 be formed of a spring material such as spring steel, that is normally relatively flat but with capability of being flexed laterally as shown in FIGS. 11 and 13.

The handle 18 is relieved or slotted to receive the spring plate 44 and to allow resilient lateral flexion of the plate between the blade locking position (FIGS. 10, 12) in which the pin 37 is received in one of the receptacles 39, 40 and the blade release and receiving position (FIGS. 11, 13). The pin 37 serves to lock the blade against both lateral (downward) and longitudinal movement (forward or backward) when received in one of the receptacles 39 or 40.

It is pointed out that the spring plate 44 may be mounted to the hand grip section 25 of the handle, or to the blade back 30. In folding knives or knives in which the blade is movable relative to the handle (not shown), it is preferred that the spring plate be mounted to the blade back. In fixed blade knives such as those shown, the release may be selectively mounted, depending upon overall knife design. For example, the free end of the spring plate could be positioned for operation from above or below the blade. Further, the angular orientation of the spring plate could be other than that shown. For example, the spring plate could extend longitudinally into the handle, instead of the transverse orientation shown.

Figure 6:
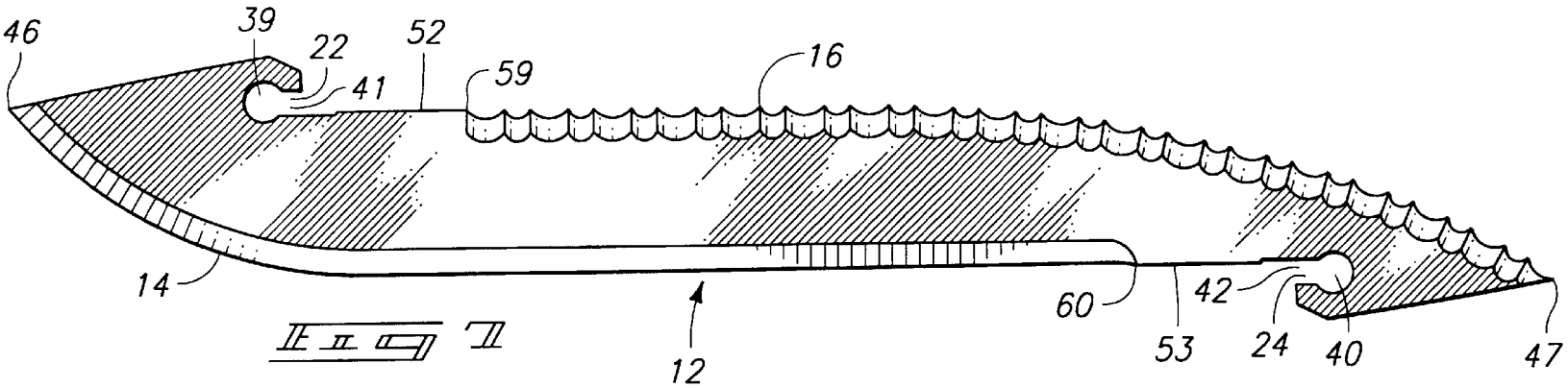
FIG. 6 is side elevational view of a preferred reversible blade.

FIGS. 5–7 are illustrative of preferred blades 12 which may be produced and distributed separately from the remainder of the knife. This is an advantage especially where it is desirable to use disposable blades, or in situations where a blade becomes damaged or worn and requires replacement. Replacement of a blade 12 is far more economical than replacement of an entire knife. Further, the reversible nature of the blade and the blade mounting elements on the handle facilitate fast and easy interchangeability of two cutting edges without requiring that the user either carry extra blades or extra knives.

As shown in FIG. 6, the blade 12 includes opposed longitudinal first and second cutting edges 14, 16 that are longitudinally oriented along the blade and face in opposite directions. The first cutting edge 14 leads from a first blade tip 46 to a the second handle mounting surface 24. The second cutting edge 16 leads from a second blade tip 47 to the first handle mounting surface 22. The edges 14, 16 longitudinally overlap to present normal elongated cutting edges within a minimal blade length.

In the preferred form shown in FIG. 6, the first and second cutting edges 14, 16 are substantially identical but opposite, as are the first and second handle mounting surfaces 22, 24. The first and second handle mounting surfaces 22, 24 are respectively situated along the longitudinal edges 16, 14 of the blade adjacent the opposed first and second blade tips 46, 47.

The handle mounting surfaces 22, 24 begin at first and second choils 59, 60 which are positioned longitudinally between the respective cutting edges and adjacent blade tips. As shown in FIG. 6, the first handle mounting surface 22 is longitudinally situated between the first choil 59 (of the second cutting edge 16) and the first blade tip 46. The second handle mounting surface 24 is situated between the second choil 60 (of the first cutting edge 14) and the second blade tip 47.

The handle mounting surfaces 22, 24 include first and second flange receiving slots 41, 42 and the locking device receiving receptacles 39, 40. The mounting surfaces 22, 24 also include first and second raised back engaging lands 52, 53 that are situated longitudinally between the choils 59, 60 and the respective knife points 46, 47.

It is preferred that the lands 52, 53 longitudinally positioned between the respective first and second choils 59, 60 and the first and second flange receiving slots 41, 42.

Lands 52, 53 stand proud of the associated cutting edges 16, 14. Depending upon which cutting edge is exposed, one of the two lands 52, 53 will engage and abut with the rigid back 30 at the base of the blade receiving slot. The land 52 or 53 thus employed will function to hold the adjacent cutting edge from engagement with the slot base and protect the edge from being dulled or from cutting into the back 30.

Referring to FIG. 5, an enlarged view of one land 52 is shown in abutment with the slot base on the rigid back 30. The adjacent knife edge 16 is also shown spaced clear of the back surface. With this mounting arrangement, there is no danger that the cutting edge presently adjacent to the base of blade receiving slot will be pushed against the back 30 during use. The inoperative blade edge and back are thus protected against damage.

In FIG. 6, a center defined by longitudinally and transversely bisecting X and Y axes divides the blade 12 into 4 quadrants: A, B, C and D. The point and blade structure found in quadrant A is a mirror image of the point and blade structure found in the diagonally opposed quadrant D. Likewise, the edge and blade structure found in quadrant B is a mirror image of the edge and blade structure found in the diagonally opposed quadrant C. With this arrangement, the blade and tip configuration that is exposed when the blade is secured to the blade mount 20 will be substantially identical regardless of which cutting edge is in use.

Attention is drawn in FIG. 5 to the engaged surfaces of the first mounting flange receiving slot 41 and the top of the blade tip mounting flange 34. A small space is shown between the flange bottom and the bottom surface of the tip mounting flange 34. The slot 41 is wider than the thickness (measured vertically in FIG. 5) of the tip mounting flange 34. The illustrated slot width allows the blade to easily slip over the tip mounting flange 34, yet the space between the top surface of the slot and the associated land 52 is approximately equal to the flange thickness. This relationship facilitates mounting and dismounting of the blade on the handle but also provides for secure positioning of the blade relative to the back once the blade is mounted.

When the blade 12 is properly mounted to the rigid back 30, the relationship shown in FIG. 5 occurs; with the top surface of the mounting flange receiving slot 41 resting against the top of the flange 34, and with the land 52 in flush engagement with the rigid back (within the blade receiving slot). This assures a snug fit between the rigid back and the blade so the blade will not chatter or wobble when in use. At the other end of the blade, pin 37 is used to securely hold the blade in position against longitudinal movement and against movement toward or away from the back 30. Still further, the walls of the rigid back 30 that define the blade receiving slot 32 serve to hold the blade against sideways movement. The blade is thus held very securely in relation to the remainder of the knife.

To change the blade or reverse the cutting edges, the user simply presses the spring plate at its free end, to bend the plate and to slide the pin 37 from engagement with the associated pin receiving receptacle on the blade. This step is easily and quickly accomplished without requiring special tools or disassembly of any part from the knife.

Once the pin 37 leaves engagement with the blade, the user may grasp the blade along its sides, then shift it longitudinally in a forward direction to disengage the flange 34 from the flange receiving slot. The blade will easily slip free of the handle. The user may elect to dispose of the blade, store it for later sharpening, or reverse it so the other cutting edge is exposed.

To reverse the blade, the user simply turns the blade end-for-end (on axis Y as shown in FIG. 6) and flips the blade over (on axis X again as shown in FIG. 6). Now the blade may be re-mounted to the handle by simply reversing the steps described above for removing the blade.

In FIG. 7 a different blade structure is shown to exemplify the capability of the present blade to be produced with different cutting edges. Here the cutting edges are not diagonally symmetrical as are the cutting edges shown in FIG. 6. However even with the cutting edge differences, the knife mounting surfaces of the two differently shaped blades remain similar. The alternate blade shown in FIG. 7 can thus be used interchangeably with the symmetrical blade shown in FIG. 6. Of course other variations of cutting edge shape and design are also possible.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A knife, comprising:

a handle;

a blade mount on the handle;

an elongated blade having opposed first and second longitudinal cutting edges extending between first and second blade ends;

wherein the first blade end is situated adjacent the second longitudinal edge and the second blade end is situated adjacent the first longitudinal edge;

wherein the first cutting edge extends from the first blade end toward the second blade end and the second cutting edge extends from the second blade end toward the first blade end;

a first choil along the second cutting edge;

a second choil along the first cutting edge;

a first handle mounting surface on the blade and spaced longitudinally between the first blade end and first choil;

a second handle mounting surface on the blade and spaced longitudinally between the second blade tip and second choil; and wherein the handle mounting surfaces on the blade are interchangeably engageable with the blade mount on the handle to enable selective attachment of the blade to the handle with either first or second cutting edge exposed in an operational position.

2. The knife of claim 1, further comprising a rigid blade back projecting from the handle and wherein the blade mount is integral with the rigid blade back.

3. The knife of claim 1, wherein the handle includes a rigid blade back and wherein the rigid blade back is slotted to slidably receive and brace the blade.

4. The knife of claim 1, wherein the handle includes a rigid blade back and wherein the blade back includes a tang section that is secured to the handle.

5. The knife of claim 1, wherein the handle includes:

a hand grip section including a pommel at one hand grip end, and a bolster at a forward end;

a rigid blade back projecting from the bolster; and wherein the blade mount is positioned on the rigid blade back.

6. The knife of claim 1, wherein the handle includes:

a hand grip section including a pommel at one hand grip end, and a bolster at a forward end;

a rigid blade back projecting from the bolster;

wherein the blade mount includes a blade tip mounting flange at a forward end and a locking device adjacent the bolster; and a release mounting the locking device to the handle and configured to move the locking device between a blade locking position and a blade release and receiving position.

7. The knife of claim 1, wherein the handle mounting surfaces on the blade are substantially identical; and wherein the blade mount on the handle includes blade mounting members spaced to interchangeably receive the handle mounting surfaces on the blade.

8. The knife of claim 1, wherein the handle includes a handgrip and a rigid back including a longitudinal blade receiving slot extending from a blade tip mounting end to a bolster end adjacent the handgrip.

9. A knife, comprising:

a handle extending from a pommel end to a bolster at a forward end;

the handle further including a rigid blade back projecting from the bolster and including a blade tip mounting flange spaced from the bolster;

a locking device;

a release mounting the locking device to the handle and configured to move the locking device between a blade locking position and a blade release and receiving position;

an elongated blade including a blade body having opposed first and second longitudinal cutting edges extending between first and second blade ends;

first and second choils along the blade edges and adjacent the respective first and second blade ends;

wherein the first cutting edge extends along the blade from the first blade end to the second choil;

wherein the second cutting edge extends along the blade from the second blade end to the first choil;

first and second mounting flange receiving slots formed in the blade and between the respective first and second choils and the first and second blade ends, each configured to receive the blade tip mounting flange;

first and second locking device receiving receptacles formed in the blade adjacent the respective first and second mounting flange receiving slots;

wherein the blade is reversibly mountable to the rigid blade back with either cutting edge exposed and with either of the first or second mounting flange receiving slots receiving the mounting flange, and with either first or second locking device receiving receptacles releasably receiving the locking device.

10. A reversible double edge knife blade, comprising:

an elongated blade body having opposed first and second longitudinal overlapping cutting edges extending between first and second blade ends;

wherein the second longitudinal cutting edge extends from the second blade end to a first choil;

wherein the first longitudinal cutting edge extends from the first blade end to a second choil;

a first handle mounting surface on the blade body and disposed thereon between the first choil and the first blade end; and a second handle mounting surface on the blade body and disposed thereon between the second choil and the second blade end.

11. The reversible double edge knife blade of claim 10, wherein each handle mounting surface includes a blade back engaging land longitudinally situated between an associated choil and blade end.

12. The reversible double edge knife blade of claim 10, wherein each handle mounting surface includes a lock device receiving receptacle and an adjacent mounting flange receiving slot.

13. The reversible double edge knife blade of claim 10, wherein each handle mounting surface includes a lock device receiving receptacle and an adjacent mounting flange receiving slot opening into the lock device receiving receptacle.

14. The reversible double edge knife blade of claim 10, further comprising a raised land that extends longitudinally from each choil toward an associated blade end.

* * * * *